US009197959B2

(12) United States Patent
Fukushima et al.

(10) Patent No.: US 9,197,959 B2
(45) Date of Patent: Nov. 24, 2015

(54) HEADPHONE DEVICE

(71) Applicant: D&M Holdings, Inc., Kanagawa (JP)

(72) Inventors: Yoshinari Fukushima, Kanagawa (JP); Kazuo Ochiai, Kanagawa (JP)

(73) Assignee: D&M HOLDINGS, INC., Kanagawa (JP)

( * ) Notice: Subject to any disclaimer, the term of this patent is extended or adjusted under 35 U.S.C. 154(b) by 0 days.

(21) Appl. No.: 14/368,647

(22) PCT Filed: Oct. 31, 2012

(86) PCT No.: PCT/JP2012/078097
§ 371 (c)(1),
(2) Date: Sep. 3, 2014

(87) PCT Pub. No.: WO2013/099429
PCT Pub. Date: Jul. 4, 2013

(65) Prior Publication Data

US 2014/0369545 A1 Dec. 18, 2014

(30) Foreign Application Priority Data

Dec. 26, 2011 (JP) ..... 2011-283068

(51) Int. Cl.
*H04R 1/10* (2006.01)

(52) U.S. Cl.
CPC ..... *H04R 1/1058* (2013.01); *H04R 1/1016* (2013.01)

(58) Field of Classification Search
CPC ..... H04R 2225/023; H04R 2225/025; H04R 1/105; H04R 2225/021; H04R 2225/63; H04R 1/10; H04R 2225/022; H04R 2460/13; H04R 1/1016
USPC ..... 381/328, 330, 370, 380
See application file for complete search history.

(56) References Cited

U.S. PATENT DOCUMENTS

| | | | | |
|---|---|---|---|---|
| 7,522,743 | B2 * | 4/2009 | Dobras et al. | 381/380 |
| 7,986,803 | B1 * | 7/2011 | DeKalb | 381/380 |
| 8,385,574 | B2 * | 2/2013 | Aquilina et al. | 381/380 |
| 8,774,434 | B2 * | 7/2014 | Zhao et al. | 381/380 |
| 2009/0034775 | A1 * | 2/2009 | Burton | 381/380 |
| 2011/0293130 | A1 * | 12/2011 | Huang | 381/380 |

FOREIGN PATENT DOCUMENTS

| | | | |
|---|---|---|---|
| JP | 2007-189468 | A | 7/2007 |
| JP | 2010-200074 | A | 9/2010 |
| JP | 2011-009909 | A | 1/2011 |

* cited by examiner

*Primary Examiner* — Suhan Ni
(74) *Attorney, Agent, or Firm* — Peter A. Nieves; Sheehan Phinney Bass + Green

(57) ABSTRACT

[Problem] To provide a headphone device that is equipped with an ear pad to be inserted into an ear, is electrically connected to a player device via a cable and outputs an audio signal which is output from the player device, with which it is possible to improve in-ear wearability and prevent a pain from being caused inside the ear. [Solution] The headphone device is equipped with: a driver unit that is fixed to a housing and has a diaphragm for emitting a sound of an audio signal; and a nozzle section that is fixed to the housing at one end, holds an ear pad at the other end, has a hollow interior, and is formed so as to slope from the part where the nozzle is fixed to the housing toward the tip of the nozzle section at a predetermined angle with respect to the housing.

11 Claims, 5 Drawing Sheets

HEADPHONE DEVICE

CROSS-REFERENCE TO RELATED APPLICATIONS

This application is the National Stage of International Application No. PCT/JP2012/078097, filed Oct. 31, 2012, which claims the benefit of Japanese Patent Application No. 2011-283068, filed Dec. 26, 2011. The contents of these prior applications are incorporated by reference herein in their entirety.

TECHNICAL FIELD

The present invention relates to a headphone device to be connected to a reproducing device through a cable, for outputting an audio signal output from the reproducing device.

BACKGROUND ART

As a related-art headphone device, there is known a headphone device including an ear pad to be inserted into an inside of an ear of a user, and electrically connected to a reproducing device through a cable, for outputting an audio signal output from the reproducing device.

In the related-art headphone device of a type in which the ear pad is inserted into the inside of the ear, in order to enhance wearing comfort of the headphone device inside the ear of the user, a protruding angle of the ear pad is offset by a given angle with respect to a housing, and thus the wearing comfort of the headphone device in the ear is enhanced (for example, see Patent Literature 1).

FIG. 5 is a top view illustrating a state in which the related-art headphone device, in which the protruding angle of the ear pad is offset by a given angle with respect to the housing, is attached to the ear of the user.

In FIG. 5, the upper side of the drawing sheet corresponds to an outer side of the ear of the user, and the right side of the drawing sheet corresponds to a front side of the user.

As illustrated in FIG. 5, a related-art headphone device 100 includes a housing 200 and an ear pad 4. The ear pad 4 is formed of an elastic body such as a resin/rubber member, and is arranged to be offset toward the front side of the user by a given angle with respect to the housing 200. Through a cable (not shown), the headphone device 100 inputs an audio signal output from a reproducing device (not shown) to a driver unit provided inside the housing 200, and the driver unit outputs the audio signal as a sound wave. The sound wave of the audio signal output by the driver unit is transmitted through the ear pad, and is emitted as sound to the inside of the ear of the user.

When attaching the headphone device 100 to an ear 50, as illustrated in FIG. 5, a distal end of the ear pad 4 is inserted from an ear concha 501 toward an ear canal 502, and an outer peripheral portion of the ear pad 4 is held on an inner wall of an ear canal entrance 503. At this time, the ear canal entrance 503 of the ear 50 protrudes forward from an inner side of the ear concha 501. Accordingly, the ear pad 4 of the headphone device 100 is arranged to be offset toward the front side of the user with respect to the housing 200, and thus the outer peripheral portion of the ear pad 4 is properly held on the inner wall of the ear canal entrance 503. As a result, wearing comfort of the headphone device 100 is enhanced.

CITATION LIST

Patent Literature

[PTL 1] JP 2007-189468 A

SUMMARY OF INVENTION

Technical Problems

In the related-art headphone device in which the protruding angle of the ear pad is offset by a given angle with respect to the housing, under a state in which the user wears the headphone device 100 in the ear 50, a part of an outer periphery of the housing 200 partially presses a swelling portion of the ear canal entrance 503 indicated by the arrow A in FIG. 5, and the housing 200 presses a swelling portion of a tragus 504 indicated by the arrow B in FIG. 5.

Thus, when the user wears the headphone device 100 for a long period of time under a state in which the housing 200 presses the swelling portion of the ear canal entrance 503 and the swelling portion of the tragus 504, the ear canal entrance 503 and the tragus 504 are continuously pressed by the outer peripheral portion of the housing 200 for a long period of time, and hence a pain may be caused in the ear canal entrance 503 and the tragus 504. When the outer peripheral portion of the housing 200 of the related-art headphone device 100 presses the ear canal entrance 503 and the tragus 504 of the ear 50 for a long period of time to cause a pain inside the ear 50, wearing comfort of the headphone device 100 may be deteriorated.

It is an object of the present invention to provide a headphone device including an ear pad to be inserted into an inside of an ear of a user, electrically connected to a reproducing device through a cable, for outputting an audio signal output from the reproducing device, and capable of enhancing wearing comfort in the ear and preventing a pain inside the ear.

Solution to Problems

According to one embodiment of the present invention, there is provided a headphone device for outputting an audio signal input to an input terminal through a cable, the headphone device including: a driver unit fixed to a housing, the driver unit including a diaphragm for emitting the audio signal as sound; and a nozzle section having one end fixed to the housing, another end holding an ear pad, and a hollow interior, the nozzle section being formed so as to be inclined by a predetermined angle with respect to the housing in a region from a portion of the nozzle section fixed to the housing toward a distal end portion of the nozzle section.

According to another embodiment of the present invention, in the headphone device, the nozzle section includes an outwardly curved portion formed at an intermediate portion of one side surface of the nozzle section so as to swell outwardly.

According to another embodiment of the present invention, in the headphone device, the nozzle section includes an inwardly curved portion formed at an intermediate portion of one side surface of the nozzle section so as to swell inwardly.

According to another embodiment of the present invention, the headphone device further includes a wing-like plate portion formed of a thin plate and arranged above the housing.

Advantageous Effects of Invention

According to one embodiment of the present invention, it is possible to provide the headphone device including the ear pad to be inserted into the inside of the ear of the user, electrically connected to the reproducing device through the cable, for outputting the audio signal output from the reproducing device, and capable of enhancing the wearing comfort in the ear and preventing the pain inside the ear.

BRIEF DESCRIPTION OF DRAWINGS

FIG. 4(*a*) is a top view of the headphone device, and FIG. 4(*b*) is a front view of the headphone device.

DESCRIPTION OF EMBODIMENTS

Figure 5:
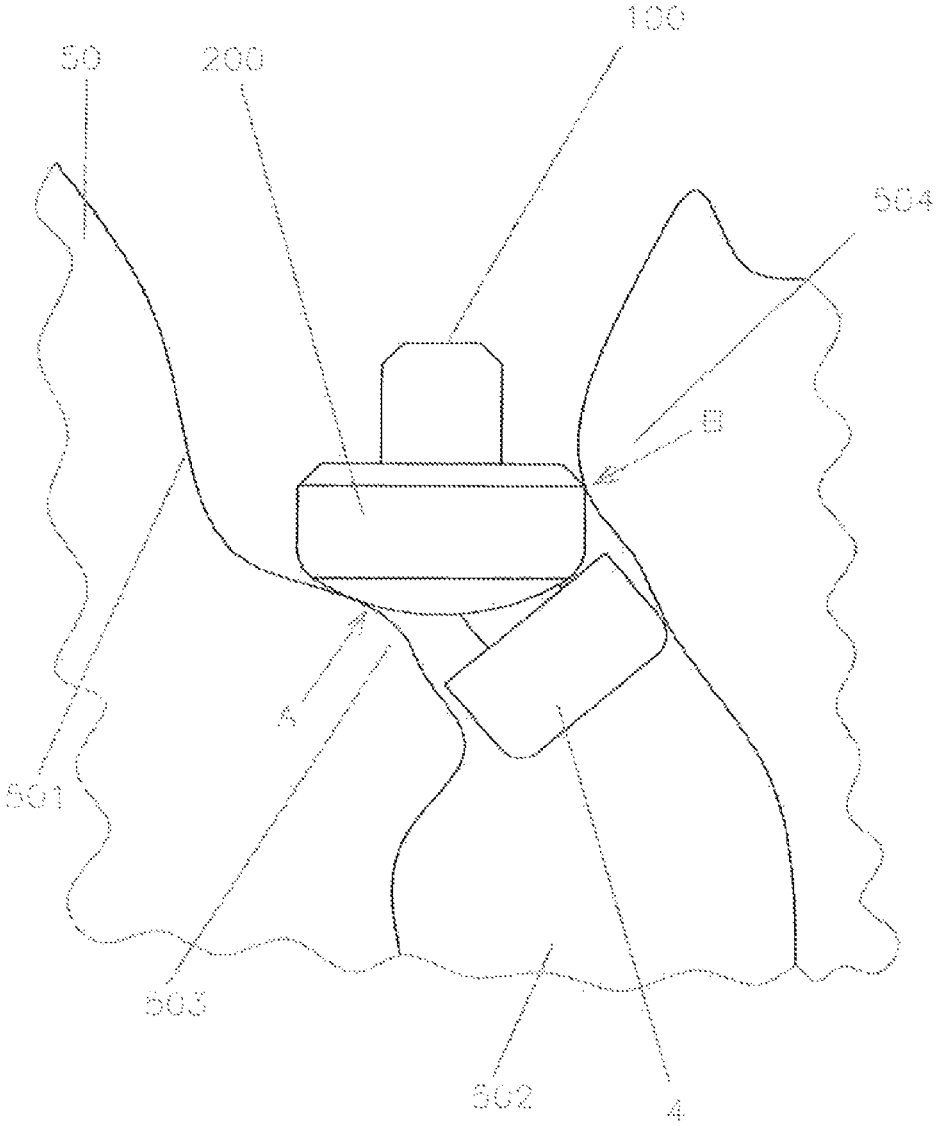
FIG. 5 is a top view illustrating a state in which a related-art headphone device, in which a protruding angle of an ear pad is offset by a given angle with respect to a housing, is attached to the ear of the user.

Embodiments of the present invention are described with reference to the drawings. Note that, the same components as those described in the "Background Art" section and illustrated in FIG. 5 are denoted by the same reference symbols.

Figure 1:
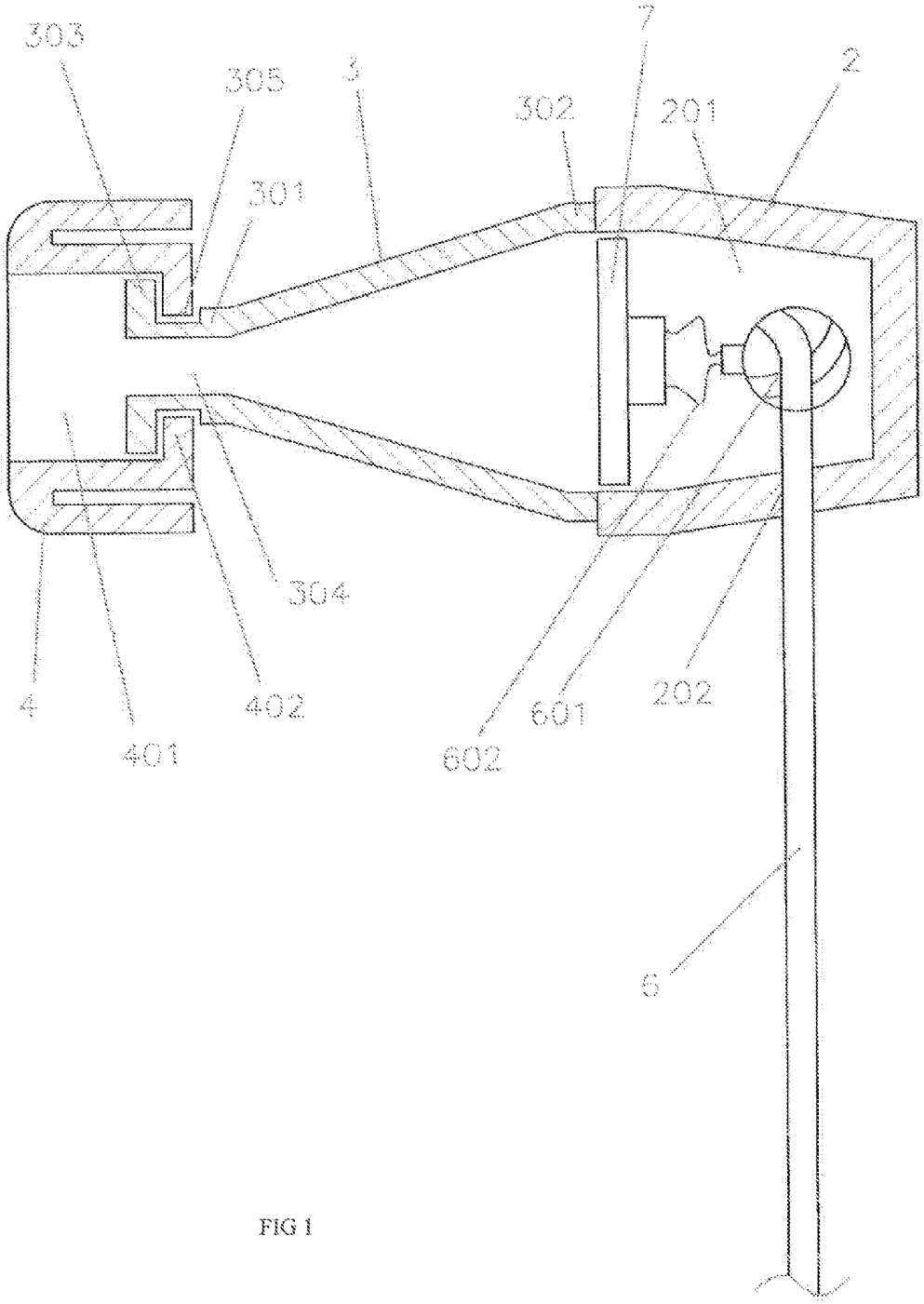
FIG. 1 is a side cross-sectional view illustrating a headphone device according to an embodiment of the present invention.

FIG. 1 is a side cross-sectional view illustrating a headphone device according to an embodiment of the present invention.

A headphone device 1 includes a housing 2, a nozzle section 3, an ear pad 4, a cable 6, a driver unit 7, and an input terminal (not shown).

In the headphone device 1 illustrated in FIG. 1, the left side of the drawing sheet corresponds to a front side of the headphone device 1, and the upper side of the drawing sheet corresponds to an upper side of the headphone device 1.

Figure 2:
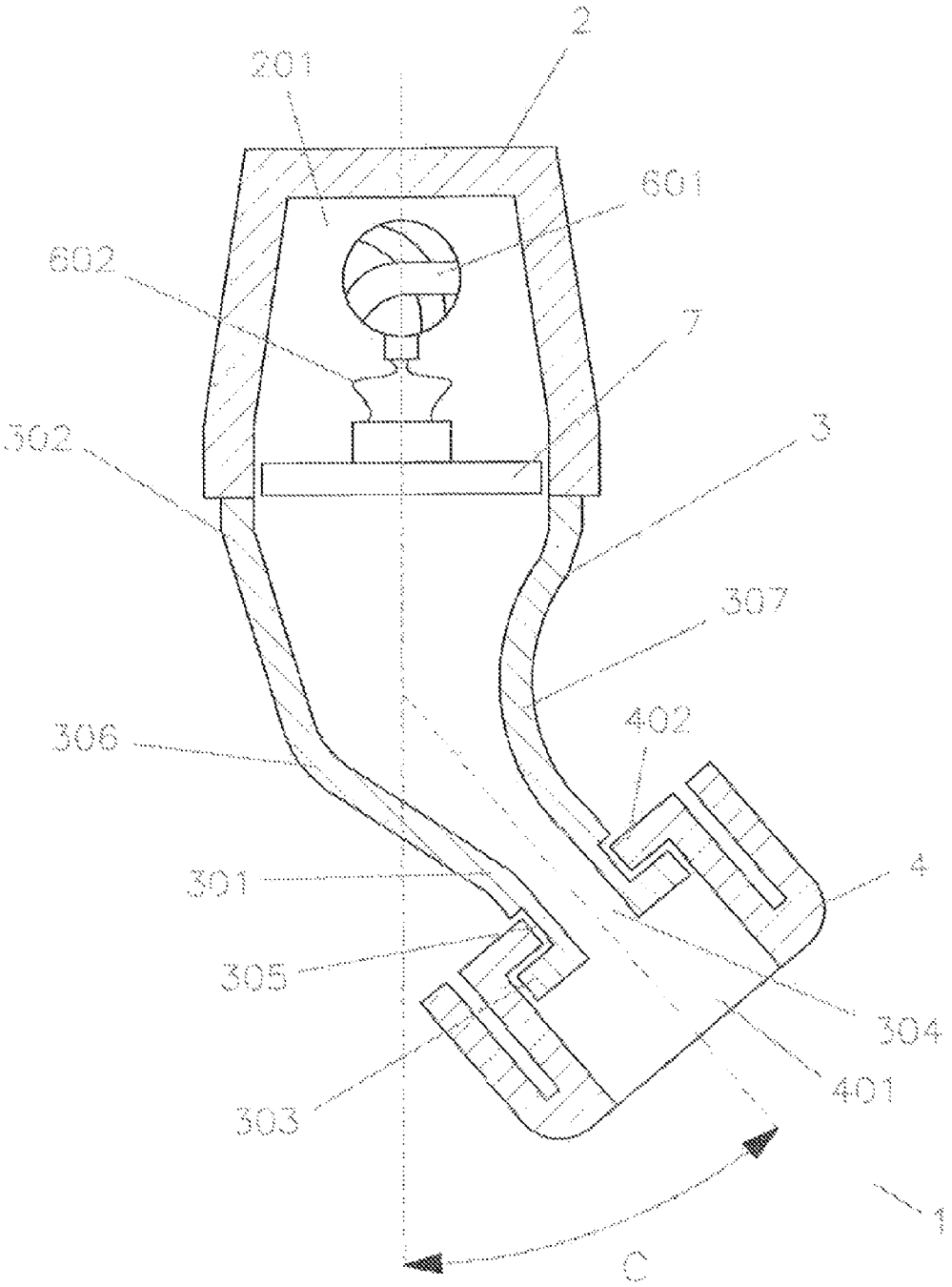
FIG. 2 is a top cross-sectional view of a headphone device 1 illustrated in FIG. 1.

FIG. 2 is a top cross-sectional view of the headphone device 1 illustrated in FIG. 1.

In the headphone device 1 illustrated in FIG. 2, the lower side of the drawing sheet corresponds to the front side of the headphone device 1, the right side of the drawing sheet corresponds to a right side of the headphone device 1, and the left side of the drawing sheet corresponds to a left side of the headphone device 1.

As illustrated in FIGS. 1 and 2, the housing 2 is formed into a cylindrical shape. The housing 2 includes a recessed portion 201 that is open to the front side of the headphone device, and a hole 202 is formed in a lower portion of the housing 2. One end of the cable 6 is inserted into an inside of the housing 2 through the hole 202 of the housing 2, and the cable 6 forms a knot 601 inside the housing 2. The knot 601 prevents the cable 6 from falling out of the housing 2 downwardly. A lead wire 602 protrudes from the one end of the cable 6 that forms the knot 601 inside the housing 2.

The driver unit 7 includes a diaphragm (not shown), and is electrically connected to the lead wire 602 of the cable 6. The driver unit 7 is fixed on an inner wall of a front portion of the housing 2 with an adhesive or the like.

As illustrated in FIG. 1, the nozzle section 3 has a hollow interior, and is formed into such a conical shape that an external shape of the nozzle section 3 is narrowed from a rear portion 302 toward a front portion 301. Further, as illustrated in FIG. 2, the nozzle section 3 is formed so as to be inclined to the right side in an offset manner by an angle C with respect to the housing 2 in a region from the rear portion 302 toward the front portion 301. In this embodiment, an angle of the inclination is set to 40 degrees. The nozzle section 3 is inclined to the right side by the angle C with respect to the housing 2 in the region from the rear portion 302 toward the front portion 301. In addition to this configuration, the nozzle section 3 includes an outwardly curved portion 306 that is formed at an intermediate portion of a left side surface of the nozzle section 3 so as to swell outwardly, and includes an inwardly curved portion 307 that is formed at an intermediate portion of a right side surface of the nozzle section 3 so as to swell inwardly.

The rear portion 302 of the nozzle section 3 is fixed to a distal end portion of the housing 2 with an adhesive or the like. A protruding portion 303 is formed on a front part of the front portion 301 of the nozzle section 3. The protruding portion 303 is formed into a cylindrical shape, and has a hole 304 formed to penetrate therethrough in a fore-and-aft direction. The protruding portion 303 includes a groove portion 305 formed in a center portion of an outer periphery thereof.

The ear pad 4 is formed of an elastic body such as a rubber member into a cylindrical shape. The ear pad 4 has a hole 401 formed to penetrate therethrough in the fore-and-aft direction. The ear pad 4 includes a flange portion 402 on an inner part on a rear side thereof. The ear pad 4 is held on a front side of the nozzle section 3 in such a manner that the flange portion 402 is fitted into the groove portion 305 of the protruding portion 303.

The headphone device 1 includes an input terminal (not shown) provided at another end of the cable 6 that is inserted into the housing 2. The input terminal is connected to an output terminal of a reproducing device (not shown). By the input terminal, the headphone device 1 inputs an audio signal output from the output terminal of the reproducing device, and emits, from the driver unit 7 through the cable 6, the audio signal input by the input terminal as sound. The user of the headphone device 1 causes the reproducing device to reproduce the audio signal under a state in which the user inserts the ear pad 4 into the ear. In this way, the audio signal reproduced by the reproducing device is emitted as sound by the driver unit 7 through the input terminal and the cable 6, and the audio signal emitted as sound is transmitted to an inside of the hole 401 of the ear pad 4 through an inside of the nozzle section 3. Thus, the user can listen to the audio signal output from the headphone device 1 in a state of wearing the headphone device 1 in the ear.

Figure 3:
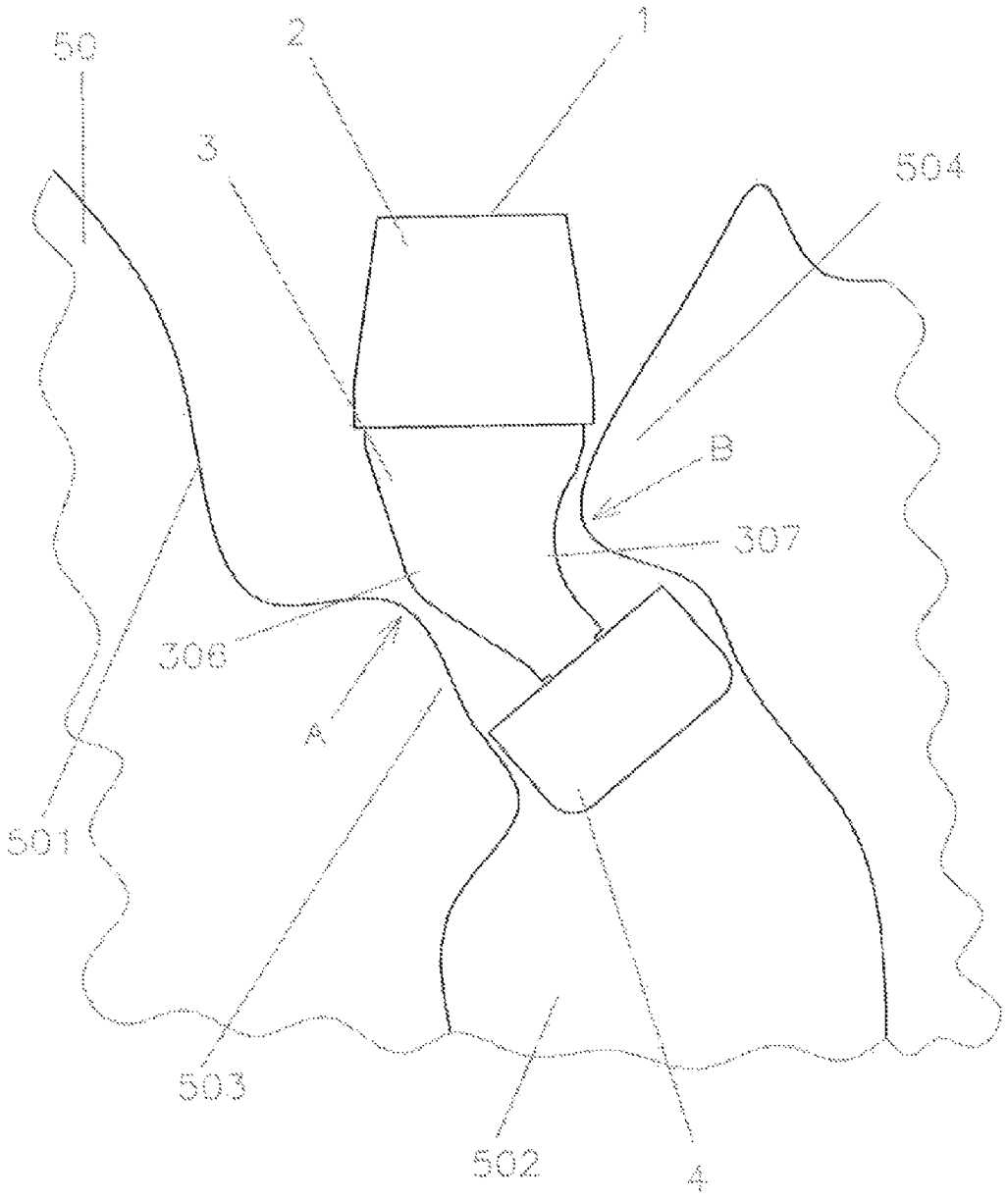
FIG. 3 is a top view illustrating a state in which the headphone device 1 according to the embodiment of the present invention is attached to an ear of a user.

FIG. 3 is a top view illustrating a state in which the headphone device 1 according to this embodiment is attached to the ear of the user.

In FIG. 3, the upper side of the drawing sheet corresponds to an outer side of the ear of the user, and the right side of the drawing sheet corresponds to a front side of the user.

When attaching the headphone device 1 to an ear 50, as illustrated in FIG. 3, a distal end of the ear pad 4 is inserted from an ear concha 501 toward an ear canal 502, and an outer peripheral portion of the ear pad 4 is held on an inner wall of an ear canal entrance 503. At this time, an inner wall of the ear canal entrance 503 inside the ear 50 protrudes forward from the inner side of the ear concha 501, and an inner wall of a tragus 504 is inclined forward in a region from an entrance of the ear 50 toward the inside of the ear. In the headphone device 1, the nozzle section 3 is formed so as to be inclined to the right side by the angle C with respect to the housing 2 in the region from the rear portion 302 toward the front portion 301, and hence wearing comfort of the headphone device 1 can be enhanced.

The headphone device 1 according to this embodiment includes the outwardly curved portion 306 that is formed at the intermediate portion of the left side surface of the nozzle section 3 so as to swell outwardly. Accordingly, under a state in which the ear pad 4 is held in the ear canal entrance 503, the nozzle section 3 and a part of an outer periphery of the housing 2 do not partially press a swelling portion of the ear canal entrance 503 indicated by the arrow A in FIG. 3, but abut on a swelling portion of the ear canal entrance 503 at a portion having a large area on the surface of the outwardly curved portion 306 of the nozzle section 3. In this way, the portion having a large area on the surface of the outwardly curved portion 306 of the nozzle section 3 abuts on the swelling portion of the ear canal entrance 503, and thus a pressing force to be applied to the ear canal entrance 503 per given area is reduced. Accordingly, it is possible to prevent the headphone device 1 from causing a pain in the ear canal entrance 503. Further, the headphone device 1 according to this embodiment includes the inwardly curved portion 307 that is formed at the intermediate portion of the right side surface of the nozzle section 3 so as to swell inwardly. Accordingly, under the state in which the ear pad 4 is held in the ear canal entrance 503, the nozzle section 3 and the outer peripheral portion of the housing 2 do not press a swelling portion of the tragus 504 indicated by the arrow B in FIG. 3.

As described above, the headphone device 1 according to this embodiment includes the outwardly curved portion 306 that is formed at the intermediate portion of the left side surface of the nozzle section 3 so as to swell outwardly, and includes the inwardly curved portion 307 that is formed at the intermediate portion of the right side surface of the nozzle section 3 so as to swell inwardly. Accordingly, even when the user wears the headphone device 1 for a long period of time, it is possible to prevent the headphone device 1 from causing a pain inside the ear 50 because of continuous pressing of the headphone device 1 onto the inner wall portion of the ear canal entrance 503 and the inner wall portion of the tragus 504.

Further, according to the headphone device 1 of this embodiment, under the state in which the headphone device 1 is inserted into the ear and the outer peripheral portion of the ear pad 4 is held on the inner wall of the ear canal entrance 503, the portion having a large area on the surface of the outwardly curved portion 306 of the nozzle section 3 abuts on the swelling portion of the ear canal entrance 503, but does not press the tragus 504. Accordingly, under a state in which the surface of the ear pad 4 properly abuts on the inner wall of the ear canal entrance 503, the audio signal output from the driver unit 7 is properly transmitted to the ear canal 502 of the ear 50 through the inside of the nozzle section 3 and the inside of the ear pad 4, and hence it is possible to enhance sound quality of the audio signal output by the headphone device 1.

As illustrated in FIG. 2, the headphone device 1 according to this embodiment has a configuration in which the nozzle section 3 is formed so as to be inclined to the right side by 40 degrees with respect to the housing 2 in the region from the rear portion 302 toward the front portion 301. However, the angle of the inclination may be set to any angle other than 40 degrees in conformity to a shape of the ear of the user. Further, for example, the angle of the inclination of the nozzle section 3 may be changed freely, and the angle of the inclination of the nozzle section 3 may be changed into an arbitrary angle in accordance with preference of the user.

The headphone device 1 according to this embodiment includes the outwardly curved portion 306 that is formed at the intermediate portion of the left side surface of the nozzle section 3 so as to swell outwardly, and includes the inwardly curved portion 307 that is formed at the intermediate portion of the right side surface of the nozzle section 3 so as to swell inwardly. However, in a case where the user does not feel uncomfortable when the outer periphery of the nozzle section 3 partially abuts on the swelling portion of the tragus 504 of the ear 50, the headphone device 1 may have a configuration in which the inwardly curved portion 307 swelling inwardly is not formed at the intermediate portion of the right side surface of the nozzle section 3, and only the outwardly curved portion 306 swelling outwardly is formed at the intermediate portion of the left side surface of the nozzle section 3.

Further, the headphone device 1 according to this embodiment includes the outwardly curved portion 306 that is formed at the intermediate portion of the left side surface of the nozzle section 3 so as to swell outwardly, and includes the inwardly curved portion 307 that is formed at the intermediate portion of the right side surface of the nozzle section 3 so as to swell inwardly. However, in a case where the user does not feel uncomfortable when the part of the outer periphery of the nozzle section 3 abuts on the swelling portion of the ear canal entrance 503 of the ear 50, the headphone device 1 may have a configuration in which the outwardly curved portion 306 swelling outwardly is not formed at the intermediate portion of the left side surface of the nozzle section 3, and only the inwardly curved portion 307 swelling inwardly is formed at the intermediate portion of the right side surface of the nozzle section 3.

The headphone device 1 according to this embodiment includes the cable 6 for inputting the audio signal from the reproducing device, but the headphone device 1 may have such a configuration that the cable 6 is not provided and, for example, the driver unit 7 inputs the audio signal from the reproducing device through wireless communication. As described above, the headphone device 1 has the configuration in which the driver unit 7 inputs the audio signal from the reproducing device through wireless communication, and thus the headphone device 1 does not need to include the cable 6. Accordingly, when the user walks or jogs, wearing comfort of the headphone device 1 can be further enhanced.

Next, a headphone device according to another embodiment of the present invention is described.

Figure 4A:
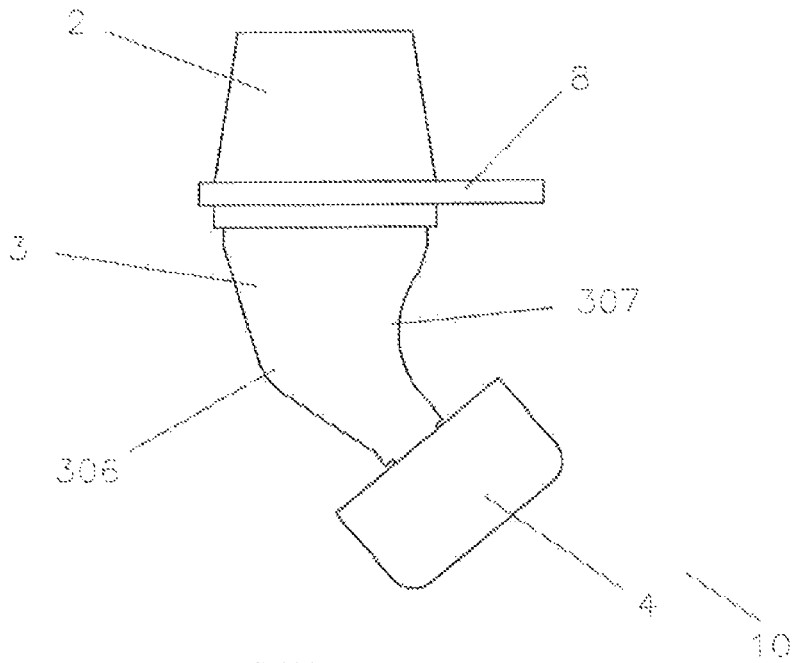
FIG. 4 are views illustrating a headphone device according to another embodiment of the present invention.
Figure 4B:
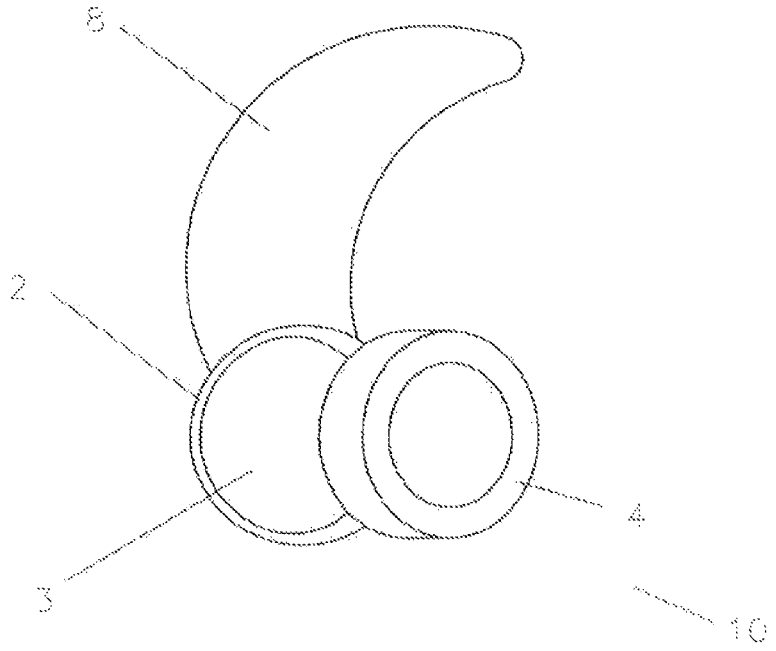

FIG. 4 are views illustrating the headphone device according to the another embodiment of the present invention. FIG. 4(*a*) is a top view of the headphone device, and FIG. 4(*b*) is a front view of the headphone device.

In FIG. 4(*a*), the lower side of the drawing sheet corresponds to a front side of the headphone device, the right side of the drawing sheet corresponds to a right side of the headphone device, and the left side of the drawing sheet corresponds to a left side of the headphone device.

In FIG. 4(*b*), the upper side of the drawing sheet corresponds to an upper side of the headphone device, the right side of the drawing sheet corresponds to the right side of the headphone device, and the left side of the drawing sheet corresponds to the left side of the headphone device.

The headphone device according to the another embodiment of the present invention has such a configuration that only a wing-like plate portion described below is added to the configuration of the headphone device 1 according to the above-mentioned embodiment, and hence description of the above-mentioned components is omitted.

As illustrated in FIG. 4, a headphone device 10 includes a wing-like plate portion 8 in addition to the above-mentioned components of the headphone device 1.

As illustrated in FIG. 4(*b*), the wing-like plate portion 8 is formed of an elastic body such as a rubber member or a plastic member, and is formed of a wing-shaped thin plate. A lower portion of the wing-like plate portion 8 is fixed to a front portion of the housing 2 so that the wing-like plate portion 8 is arranged above the front portion of the housing 2.

When attaching the headphone device 10 to the ear, similarly to the case described with reference to FIG. 3, the distal end of the ear pad 4 is inserted into the inside of the ear, and the outer peripheral portion of the ear pad 4 is held on the inner wall of the ear canal entrance. Further, the wing-like plate portion 8 arranged above the housing 2 is fitted into a depressed portion of the ear concha. In this manner, the ear pad 4 of the headphone device 10 is inserted into the inside of the ear, and the wing-like plate portion 8 abuts on an upper inner wall of the ear concha. Accordingly, the wing-like plate portion 8 abuts on the upper inner wall of the ear concha, and thus the headphone device 10 is correctly held in the depressed portion of the ear concha by the wing-like plate portion 8.

As described above, similarly to the above-mentioned headphone device 1, the headphone device 10 according to the another embodiment of the present invention includes the outwardly curved portion 306 that is formed at the intermediate portion of the left side surface of the nozzle section 3 so as to swell outwardly. Hence, the nozzle section 3 and a part of the outer periphery of the housing 2 do not partially press the swelling portion of the ear canal entrance, and the portion having a large area on the surface of the outwardly curved portion 306 of the nozzle section 3 abuts on the swelling portion of the ear canal entrance. Further, the headphone device 10 includes the inwardly curved portion 307 that is formed at the intermediate portion of the right side surface of the nozzle section 3 so as to swell inwardly. Hence, the user can wear the headphone device 10 in the ear under a state in which the nozzle section 3 and the outer peripheral portion of the housing 2 do not press the swelling portion of the tragus. In addition, the wing-like plate portion 8 abuts on the upper inner wall of the ear concha, and thus the headphone device 10 can be correctly held in the depressed portion of the ear concha. Accordingly, even when a gap is formed between the outwardly curved portion 306 and the inner wall inside the ear and between the inwardly curved portion 307 and the inner wall inside the ear, the wing-like plate portion 8 abuts on the upper inner wall of the ear concha, and thus the headphone device 10 is correctly held in the depressed portion of the ear concha. Accordingly, it is possible to prevent the ear pad 4 from falling out of the ear and prevent displacement of a position of wearing the ear pad 4 while the user wears the headphone device 10 in the ear.

The headphone device 10 according to the another embodiment of the present invention has such a configuration that the wing-like plate portion 8 is formed of a wing-shaped thin plate and is fixed to the housing 2 so as to be arranged above the front portion of the housing 2. However, the wing-like plate portion 8 may have any shape other than the wing-like shape as long period of as the wing-like plate portion 8 can be fitted into the depressed portion of the ear concha. Further, the headphone device 10 may have a configuration in which the wing-like plate portion 8 is not fixed to the housing 2, but is fixed to, for example, the ear pad 4 or the nozzle section 3.

The headphone device 10 according to the another embodiment of the present invention has such a configuration that the wing-like plate portion 8 is fixed to the housing 2. However, the wing-like plate portion 8 may be removable from the housing 2 or the nozzle section 3 of the headphone device 10. In this case, for example, a recessed portion is formed in an upper surface portion of the housing 2, and a protruding portion is formed on a bottom portion of the wing-like plate portion 8. The protruding portion of the wing-like plate portion 8 is configured to be fitted into the recessed portion of the housing 2, and thus the wing-like plate portion 8 is removable from the housing 2. With this configuration, the headphone device 10 can be shifted between a state of including the wing-like plate portion 8 and a state of not including the wing-like plate portion 8 in accordance with preference of the user, and hence it is possible to enhance convenience when wearing the headphone device 10 in accordance with the user's purpose, feeling in use, and the like.

In the headphone device 10 according to the another embodiment of the present invention, the wing-like plate portion 8 is formed of a thin plate. However, the wing-like plate portion 8 may be formed of, for example, a thin mesh material other than a thin plate member, or may have protrusions and recesses or a plurality of holes formed in the surface of the wing-like plate portion 8. With this configuration, it is possible to enhance a wearing feeling when the wing-like plate portion 8 touches the ear, and hence wearing comfort in a case of wearing the headphone device 10 in the ear can be further enhanced.

INDUSTRIAL APPLICABILITY

The present invention can be effectively applied to the headphone device to be connected to the reproducing device through the cable, for outputting the audio signal output from the reproducing device.

REFERENCE SIGNS LIST

1 headphone device, 2 housing, 201 recessed portion, 202 hole, 3 nozzle section, 301 front portion, 302 rear portion, 303 protruding portion, 304 hole, 305 groove portion, 306 outwardly curved portion, 307 inwardly curved portion, 4 ear pad, 401 hole, 402 flange portion, 6 cable, 601 knot, 602 lead wire, 7 driver unit, 8 wing-like plate portion, 50 ear, 501 ear concha, 502 ear canal, 503 ear canal entrance, 504 tragus, 10 headphone device, 100 headphone device, 200 housing

The invention claimed is:

1. A headphone device for outputting an audio signal input to an input terminal through a cable, the headphone device comprising: a driver unit fixed to a housing, the driver unit comprising a diaphragm for emitting the audio signal as sound; and a nozzle section having one end fixed to the housing, another end holding an ear pad, and a hollow interior, the nozzle section being formed so as to be inclined by a predetermined angle with respect to the housing in a region from a portion of the nozzle section fixed to the housing toward a distal end portion of the nozzle section, the nozzle section comprising an outwardly curved portion formed at an intermediate portion of a first side surface of the nozzle section so as to swell outwardly, and an inwardly curved portion formed at an intermediate portion of a second side surface of the nozzle section so as to swell inwardly, the first side surface opposing the second side surface.

2. A headphone device according to claim 1, wherein when the headphone device is positioned within an ear, the ear pad is configured and arranged to be disposed within an ear canal entrance, and the outwardly curved portion is configured and arranged to be disposed proximal to a swelling portion of the ear canal entrance.

3. A headphone device according to claim 2, wherein when the headphone device is positioned within an ear, a surface of the outwardly curved portion abuts on the swelling portion of the ear canal entrance.

4. A headphone device according to claim 1, wherein when the headphone device is positioned within an ear, the ear pad is configured and arranged to be disposed within an ear canal entrance, and the inwardly curved portion is configured and arranged to be disposed proximal to a swelling portion of a tragus of the ear.

5. A headphone device according to claim 4, wherein when the headphone device is positioned within an ear, the inwardly curved portion is configured and arranged to not press the swelling portion of the tragus of the ear.

6. A headphone device according to claim 1, further comprising a wing-like plate portion formed of a thin plate and arranged above the housing.

7. A headphone device according to claim 1, wherein when the headphone device is positioned within an ear, the ear pad is configured and arranged to be disposed within an ear canal entrance, the outwardly curved portion is configured and arranged to be disposed proximal to a swelling portion of the ear canal entrance, and the inwardly curved portion is configured and arranged to be disposed proximal to a swelling portion of a tragus of the ear.

8. A headphone device for outputting an audio signal input to an input terminal through a cable, the headphone device comprising: a driver unit fixed to a housing, the driver unit comprising a diaphragm for emitting the audio signal as sound; and a nozzle section having one end fixed to the housing, another end holding an ear pad, and a hollow interior, the nozzle section being formed so as to be inclined by a predetermined angle with respect to the housing in a region from a portion of the nozzle section fixed to the housing toward a distal end portion of the nozzle section, the nozzle section comprising an outwardly curved portion formed at an intermediate portion of one side surface of the nozzle section so as to swell outwardly, wherein when the headphone device is positioned within an ear, the ear pad is configured and arranged to be disposed within an ear canal entrance, and a surface of the outwardly curved portion is configured and arranged to abut a swelling portion of the ear canal entrance.

9. A headphone device according to claim 8, further comprising a wing-like plate portion formed of a thin plate and arranged above the housing.

10. A headphone device for outputting an audio signal input to an input terminal through a cable, the headphone device comprising: a driver unit fixed to a housing, the driver unit comprising a diaphragm for emitting the audio signal as sound; and a nozzle section having one end fixed to the housing, another end holding an ear pad, and a hollow interior, the nozzle section being formed so as to be inclined by a predetermined angle with respect to the housing in a region from a portion of the nozzle section fixed to the housing toward a distal end portion of the nozzle section, the nozzle section comprising an inwardly curved portion formed at an intermediate portion of one side surface of the nozzle section so as to swell inwardly, wherein when the headphone device is positioned within an ear, the ear pad is configured and arranged to be disposed within an ear canal entrance, and the inwardly curved portion is configured and arranged to not press a swelling portion of the tragus of the ear.

11. A headphone device according to claim 10, further comprising a wing-like plate portion formed of a thin plate and arranged above the housing.

* * * * *